US012213595B2

(12) United States Patent
Knudsen et al.

(10) Patent No.: US 12,213,595 B2
(45) Date of Patent: Feb. 4, 2025

(54) CUSHIONING AND SUPPORT SYSTEM

(71) Applicant: Inconceivable Ventures, Inc., Heber, UT (US)

(72) Inventors: Chris Knudsen, Heber, UT (US); Peter Lemon, Cedar Hills, UT (US); Joe Nilson, Alpine, UT (US); Lavon Bennett, Mesa, AZ (US)

(73) Assignee: Inconceivable Ventures, Inc., Heber, UT (US)

( * ) Notice: Subject to any disclaimer, the term of this patent is extended or adjusted under 35 U.S.C. 154(b) by 209 days.

(21) Appl. No.: 17/950,981

(22) Filed: Sep. 22, 2022

(65) Prior Publication Data

US 2023/0096812 A1 Mar. 30, 2023

Related U.S. Application Data

(60) Provisional application No. 63/248,317, filed on Sep. 24, 2021.

(51) Int. Cl.
*A47C 27/20* (2006.01)
*A47C 27/06* (2006.01)

(52) U.S. Cl.
CPC ..... *A47C 27/06* (2013.01)

(58) Field of Classification Search
CPC ..... A47C 27/06; A47C 27/14; A47C 27/142; A47C 27/146; A47C 27/15; A47C 27/16; A47C 27/20; A47C 27/085; A47C 27/086
See application file for complete search history.

(56) References Cited

U.S. PATENT DOCUMENTS 2,194,569 A * 3/1940 Rumpf ..... A47C 27/20 5/717
2,775,998 A * 1/1957 Osborn ..... A47C 27/144 264/46.7
3,633,228 A * 1/1972 Zysman ..... A47C 7/20 267/143
3,885,258 A * 5/1975 Regan ..... A47C 27/16 297/452.37
4,154,786 A * 5/1979 Plasse ..... B68G 11/06 264/46.7
4,161,045 A * 7/1979 Regan ..... A47C 27/148 5/727
4,335,476 A * 6/1982 Watkin ..... A47C 27/146 5/730
5,005,238 A * 4/1991 Freet ..... A47C 27/085 5/680
6,061,856 A * 5/2000 Hoffmann ..... A47C 27/148 5/724

(Continued)

*Primary Examiner* — Justin C Mikowski
*Assistant Examiner* — Ifeolu A Adeboyejo
(74) *Attorney, Agent, or Firm* — Klarquist Sparkman, LLP

(57) ABSTRACT

In some embodiments, a support structures can be formed from a support structure matrix comprising a plurality of layers and a plurality of spring structures embedded within the plurality of layers of the support structure matrix. The plurality of spring structures have a plurality of different durometers. The plurality of spring structures can be configured to deform and return to its original shape after deformation. The orientation and structure of the spring structures can vary depending on a desired durometer and/or function within the support structure.

30 Claims, 12 Drawing Sheets

(56) References Cited

U.S. PATENT DOCUMENTS

| | | | | |
|---|---|---|---|---|
| 6,077,378 | A * | 6/2000 | Bullard | B29C 65/564 156/303.1 |
| 2004/0172766 | A1* | 9/2004 | Formenti | A47C 27/20 5/718 |
| 2005/0115003 | A1* | 6/2005 | Torbet | A47C 27/10 5/730 |
| 2006/0282954 | A1* | 12/2006 | Poppe | F16F 1/028 5/720 |
| 2009/0126107 | A1* | 5/2009 | Kuo | A47C 27/148 5/724 |
| 2010/0218318 | A1* | 9/2010 | Steppat | A47C 27/20 267/142 |
| 2010/0223730 | A1* | 9/2010 | Pearce | A47C 27/20 5/652 |
| 2010/0227091 | A1* | 9/2010 | Pearce | B32B 3/08 428/36.1 |
| 2011/0173757 | A1* | 7/2011 | Rensink | A47C 27/15 5/655.5 |
| 2014/0373281 | A1* | 12/2014 | Mossbeck | A47C 27/053 5/718 |
| 2016/0029811 | A1* | 2/2016 | Rawls-Meehan | A47C 7/027 5/729 |
| 2016/0367042 | A1* | 12/2016 | Fisher | A47C 21/046 |
| 2017/0100860 | A1* | 4/2017 | Kumagai | A47C 7/746 |
| 2019/0365116 | A1* | 12/2019 | Roma | A47C 27/148 |
| 2023/0092044 | A1* | 3/2023 | Stojanovic | A47C 27/20 |

* cited by examiner

Standard View

Exploded View

Standard View

Exploded View

Standard Views

Exploded View

Standard View

Standard View

Exploded View

CUSHIONING AND SUPPORT SYSTEM

CROSS REFERENCE TO RELATED APPLICATION

This application claims the benefit of U.S. Provisional Application No. 63/248,317, filed Sep. 24, 2021, which is incorporated herein by reference in its entirety.

FIELD

The present disclosure relates to cushion and support systems, such as mattresses and other furniture or supporting structures.

BACKGROUND

A current shortcoming in certain cushioning devices, such as gel-based mattresses, is that one or more cushioning and supportive systems can only exist in one of two states. That is, the cushioning and supportive systems of these products exist only in a first erect, uncompressed state, and a second fully compressed and collapsed state. Because these products only exist in one of these two states, they do not offer effective and adequate support to the user. Improvements to such conventional cushioning devices are desirable.

SUMMARY

In some embodiments, a support structure can comprise a support structure matrix comprising a plurality of layers and a plurality of spring structures embedded within the plurality of layers of the support structure matrix. The plurality of spring structures have a plurality of different durometers, and the plurality of spring structures are configured to deform and return to its original shape after deformation. In other embodiments, methods of forming a support structure having a plurality of spring structures are also disclosed.

The foregoing and other objects, features, and advantages of the invention will become more apparent from the following detailed description, which proceeds with reference to the accompanying figures.

DETAILED DESCRIPTION

Figure 1:
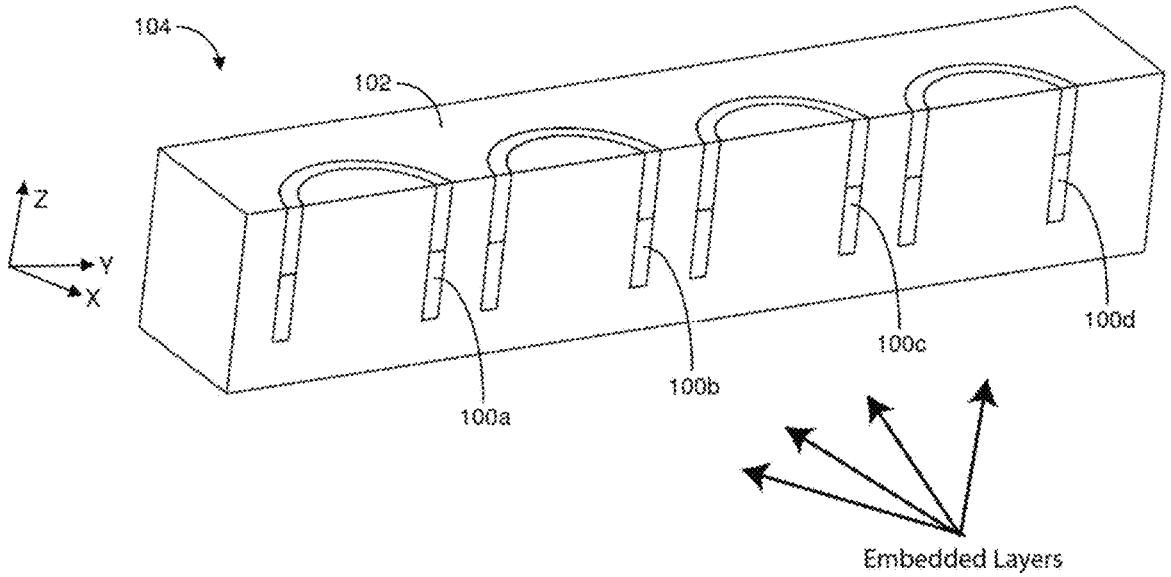
FIG. 1 illustrates an exemplary spring structure embedded in a support structure matrix.

The following description proceeds with reference to the attached figures, which are part of the application.

As used in this application the singular forms "a," "an," and "the" include the plural forms unless the context clearly dictates otherwise. Additionally, the term "includes" means "comprises." Furthermore, as used herein, the term "and/or" means any one item or combination of items in the phrase. In addition, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the term "gel-based mattress" refers to a mattress that contains at least one layer of a gel-infused matrix, such as memory foam or polyfoam.

As used herein, the term "embedded" refers to a material that is embedded into a matrix. In some embodiments, the embedded material extends at least 0.5 inches into the matrix and is a "deeply embedded material." In other embodiments, the embedded material is entirely within the matrix and is a "fully embedded material."

Conventional cushioning systems, such as gel-based mattresses, typically use cushioning elements made of a buckling column gel made only of a single durometer, which is a significant problem. The single durometer gel structure, once it collapses, stops offering any resistance, thereby providing no further support to the user.

Described herein are cushioning and support systems that provide comfort and support beyond that support provided by conventional systems. The cushioning and support systems of the present disclosure include a single or series of springs, each including two or more layers of material having varying stiffness and/or hardness (e.g., as determined by a corresponding durometer number). The springs are configured to provide progressive resistance, as additional force is applied (e.g., the weight of the user), resulting in a true variable response and in increased comfort and supportive experience to the user.

In some embodiments, the examples provided herein are in reference to gel-based mattress systems. However, it should be understood that the cushioning systems described herein can also function in other cushioning applications, such as pillows, seat cushions (e.g., automotive and furniture), as well as any other application in which a comfortable and supportive structure is desirable.

Figure 2:
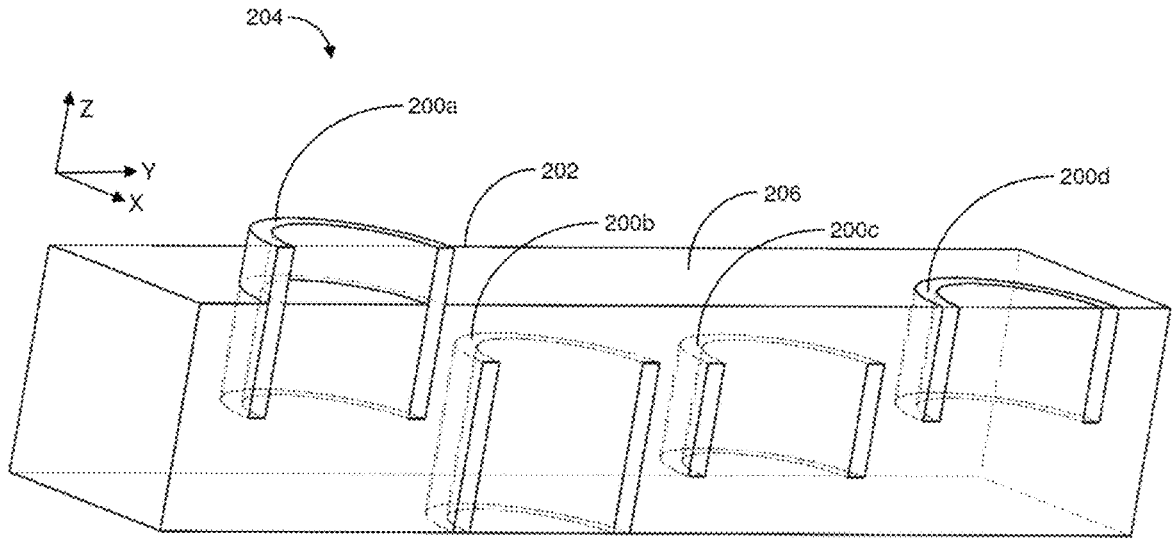
FIG. 2 illustrates another exemplary spring structure embedded in a support structure matrix.

FIGS. 1 and 2 show a perspective view of a cross-sectional segment of a support structure (e.g., a mattress) and a plurality of springs of the present disclosure embedded within the matrix or substrate of the support structure. In representative examples, the support structure matrix can be made of an open or closed cell foam and/or expandable foam. In some examples, the matrix can be made of a gel (such as those described herein), elastomer, silicone, expanded metal, wood foam, bamboo foam, natural materials, or a combination thereof. In addition to, or in lieu of those materials listed, the matrix can also include a combination of compressible solid, liquid, and/or air materials and/or elements suitable for compression.

As shown FIG. 1, the springs 100*a*-100*d* can be cylindrical in shape and situated within the matrix 102 in a sequential or linear manner along the length and/or width of the support structure 104. For example, FIG. 1 illustrates springs 100*a*-100*d* within a given segment of the support structure 104 as being axially spaced from one another and aligned along a common axial direction within the same horizontal plane (e.g., from one end of the support structure to the other end in the Y direction).

As illustrated in the drawing of FIG. 2, however, two or more springs 200 can also be arranged in a similar sequential manner but situated such that two or more springs 200 are located within different horizontal planes. For instance, similar to the example shown in FIG. 1, the springs 200 of FIG. 2 can be axially spaced from one another and aligned along a common axial direction (e.g., the Y direction). In contrast, however, the springs 200*a*-200*d* of FIG. 2 have different vertical positions relative to one another within the matrix 202 of the support structure 204 (e.g., in the Z direction of FIG. 2). As a specific example, the left most spring 200*a* can be situated such that the spring 200*a* is located in a different horizontal plane than the other springs 200*b*-200*d* and an upper portion of the spring 200*a* extends upwardly beyond the support structure surface 206. Whereas the right most spring 200*d* can be situated such that the upper most surface of the spring 200*d* is flush with the top support structure surface 206, while the two middle springs 200*b*-200*c* are embedded entirely within the body of the matrix 202.

In some examples, the springs need not be arranged sequentially or aligned along a common axial direction (e.g., the X or Y direction), but can be offset from one another. In other examples, the springs extending beyond the top surface of the support structure can be configured or positioned along the surface of the support structure to contact directly or indirectly a particular portion of the user's body (e.g., the lower back, shoulders, neck, etc.). In still further examples, one or more springs can extend beyond a first matrix layer and into a second matrix layer.

In some examples, such as where material of the support structure matrix is positioned between the lower most surface of the spring and the bottom surface of the support structure, the material composing the matrix can provide a certain degree of resistance in addition to the resistance provided by that spring. Such additional resistance as provided by the matrix can, for example, be determined by the material characteristics of that matrix's material, such as a top cover layer of a support structure (e.g., a mattress).

In representative examples, the body of the support structure matrix can be fashioned as to form molds to fabricate one or more springs. For instance, the matrices of FIG. 1 and/or FIG. 2 can be formed (e.g., during processing, via pre-cutting, etc.) to have a cylindrical, hollowed out portion which can be used to form the springs (e.g., springs 100, 200). In such examples, a matrix can be fashioned to form all of the springs within that matrix, including springs of different shapes and/or arrangements (e.g., FIGS. 8-11). In other such examples, the matrix can be fashioned to form only a fraction of the total springs within that given matrix. In further examples, each spring can be assembled and/or formed separately (e.g., via an injection molding process) and installed within the matrix.

Although the springs are described as being embedded and/or associated with a single support structure matrix, it should be understood that any support structure comprising the springs of the present disclosure can include two or more support structure matrices, each which can have their own combination and/or arrangement of springs. A support structure which includes multiple matrices in this way can, for example, be layered atop one another, with or without other materials therebetween.

Turning now to FIGS. 3-11, the springs of the present disclosure can comprise single layer (e.g., as shown in FIGS. 1 and 2,) or they can comprise two or more layers stacked in a vertical arrangement. As shown in FIGS. 3A and 3B, for example, each spring 300, 302 can include two or more layers. Each spring 300, 302 can be cylindrical in shape and have an opening extending through the center of each spring 300, 302, from the bottom most surface to the upper most surface. Each layer of the spring 300 and spring 302, as such, can be ring-like in shape and arranged coaxially with one another in a vertical arrangement such that the layers are stacked. In the stacked arrangement, adjacent layers of springs can contact each other (e.g., a top surface of a bottom spring can contact a bottom surface of a top spring), or they can be separated by other materials. For example, two springs can be separated by a portion of the support structure matrix that extends between the two adjacent surfaces or they can be separated by another structure, of the same or different material, such as a ring-shaped spacer formed of gel, elastomer, silicone, expanded metal, wood foam, bamboo foam, natural materials, compressible solids, liquids, and/or air materials.

Figure 3A:
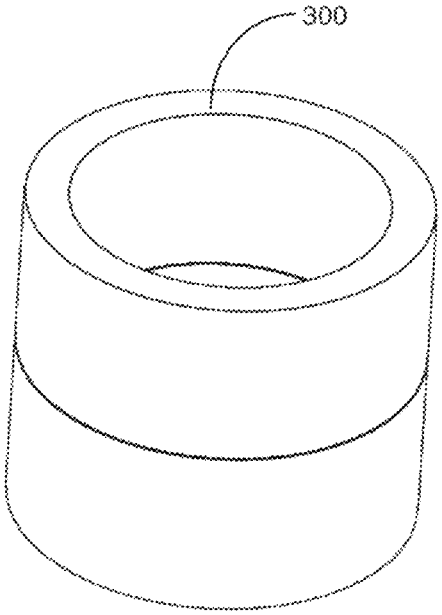
FIGS. 3A and 3B illustrate exemplary spring structures that can be embedded in a support structure matrix.
Figure 3B:
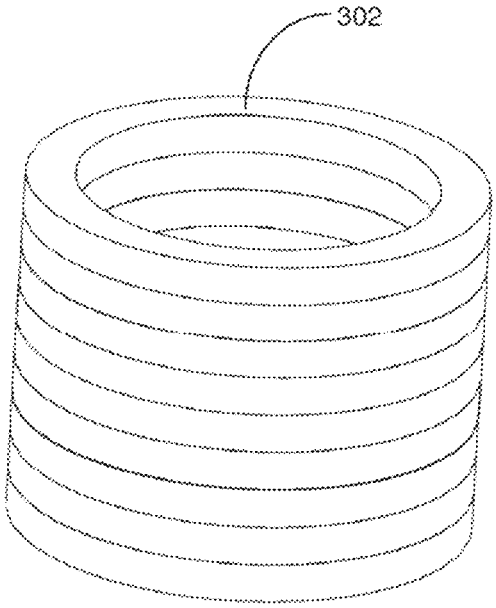

The number of stacked ring-shaped layers can vary. FIG. 3A shows two stacked ring-shaped layers, while FIG. 3B shows 9 layers. In some cases the number of layers can be between 2 and 300, and in other cases, the number of layers can exceed 300, such as 300-1,000, or even more such as 10,00-10,000.

As illustrated in the drawing of FIG. 3, each layer of both the spring 300 and spring 302 can have the same inner and outer diameters. As will be explained, however, the inner and outer diameters can differ between two or more layers.

In some examples, the layers of one spring can have a depth or height which differs from a depth or height of the layers of another spring. For instance, the spring 300 and spring 302 can have the same overall height. However, the spring 300 to the left of FIG. 3 includes two layers, whereas the spring 302 to the right of FIG. 3 includes 9 layers. In some embodiments, both springs 300 and 302 can be provided in a single support structure such that the overall heights are the same, but the individual heights of stacked springs vary. In this case, each layer of the spring 302 has a depth/height less than a depth/height of the layers of spring 300, since only two layers form the spring 300. In a similar manner, two or more layers within a single spring can have a depth/height that differs from one another.

Figure 4A:
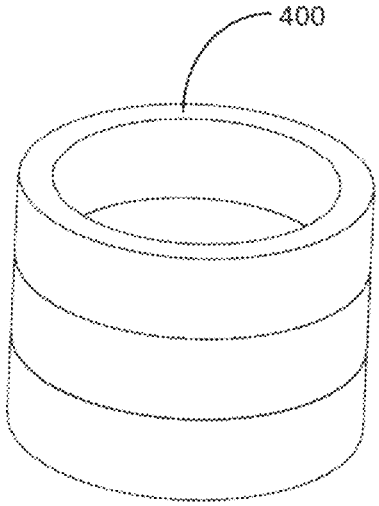
FIGS. 4A and 4B illustrate exemplary spring structures that can be embedded in a support structure matrix.
Figure 4B:
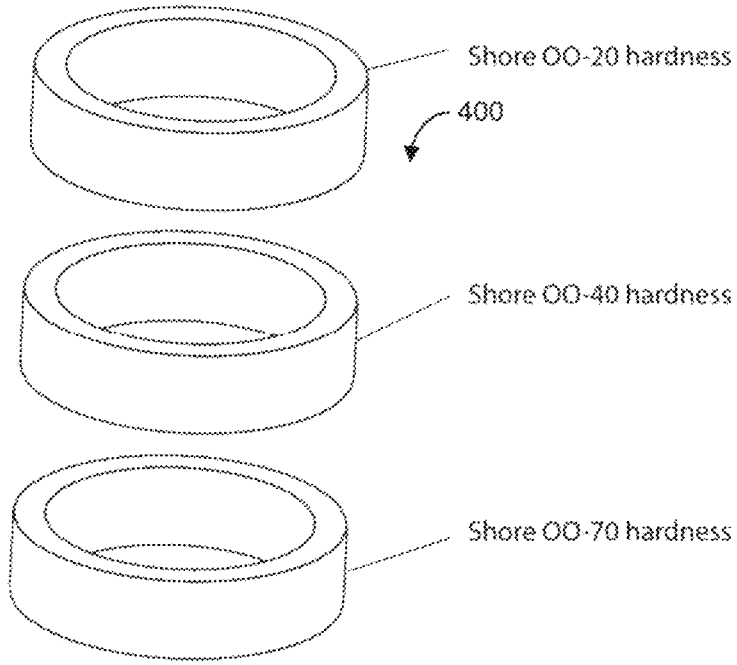

As shown in the drawings of FIGS. 4 and 5, each layer of the springs can have a hardness, as determined by a durometer number, which differs from one or more other layers. For instance, the spring 400 of FIGS. 4A and 4B, shown in both assembled and exploded views, depicts a spring with three layers, each layer having a different hardness from the adjacent layer immediately above it. Specifically, the spring 400 has a first upper layer having a hardness of Shore OO-20, a second middle layer having a hardness of Shore OO-40, and a third bottom layer having a hardness of Shore OO-70. In this configuration, the spring 400 can be said to have increasing hardness from the upper most layer to the lower most layer, or inversely, decreasing hardness from the lower most layer to the upper most layer. As such, each layer of increasing hardness moving down the length of the spring 400 can provide support to the adjacent layer immediately above it. Meaning, in the case of the spring 400 of FIG. 4, the middle layer can provide support to the upper layer as the upper layer is deformed and compressed, while the bottom layer can provide support to both the upper and middle layers as both layers become deformed and compressed.

Figure 5A:
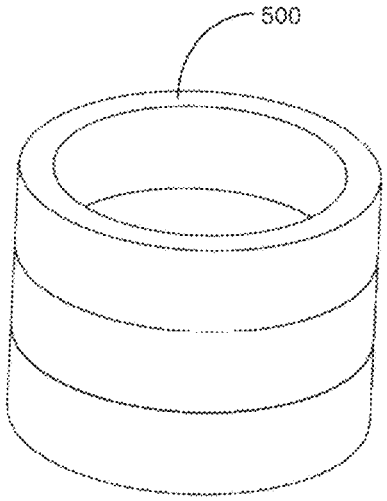
FIGS. 5A and 5B illustrate exemplary spring structures that can be embedded in a support structure matrix.
Figure 5B:
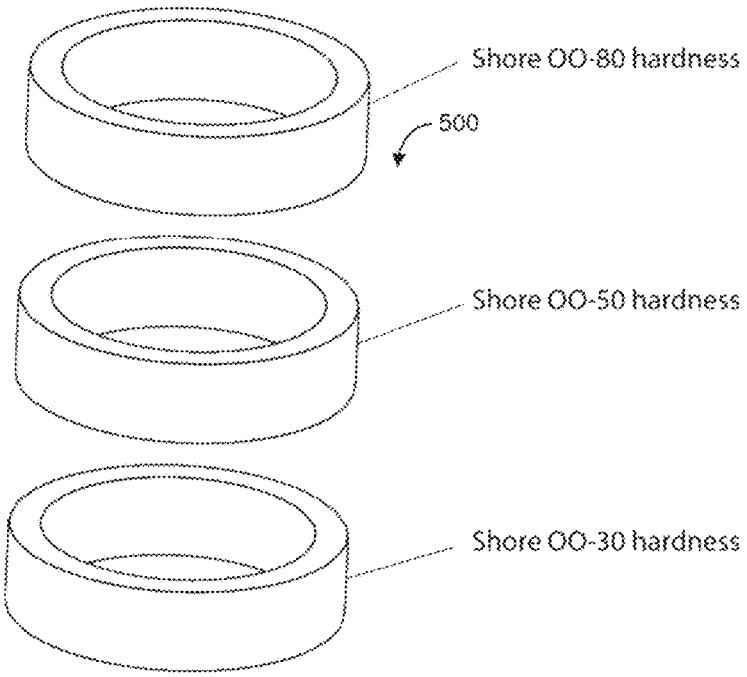

In an opposite manner, as shown on FIGS. 5A and 5B, a spring 500 can, in some examples, decrease in hardness from an upper most layer to the lower most layer, or inversely, increasing hardness from the lower most layer to the upper most layer. As an example and as shown on FIG. 5B, the spring 500 has a first upper layer having a hardness of Shore OO-80, a second middle layer having a hardness of Shore OO-50, and a third bottom layer having a hardness of Shore OO-30. In such configurations, the spring 500 can, for example, provide a firmer upper surface nearest the top surface of support structure matrix (e.g., FIGS. 1 and 2), but provide increasing softness or provide more "give" as increasing weight or downward force is applied.

Accordingly, the hardness of one or more springs can be said to increase or decrease incrementally across the longitudinal length of the springs depending on their respective layers, such as those configurations described above in reference to the springs 400, 500. In some examples, however, the hardness of the springs need not increase or decrease incrementally across the length of the spring. For instance, the springs can have a middle layer which has a hardness greater than or lesser than both the adjacent upper and lower layers.

In some examples, the springs can have any combination of layers with distinct degrees of hardness. As one example, the spring 302 of FIG. 3B, which has nine individual layers, can have layers of alternating hardness such that, for instance, one layer has a hardness relatively softer than the layer immediately preceding it and subsequent to it (and vice versa). Another example can include the same spring 302 of FIG. 3B, in which the layers within the bottom half of the spring increase incrementally in hardness upward and the layers within the upper half of the spring decrease incrementally in hardness, also upward. In such a configuration, for example, the layers with the highest degree of hardness will be located within the middle layers of the spring. In some examples, the layers can have any variation of hardness ranging from Shore D-10 to Shore OOO-1.

In representative implementations, each layer of the springs can comprise one or more elastomeric polymers which allow each layer to deform and return to its original size and shape after deformation. Elastomeric polymers can include, for instance, homopolymers, copolymers, and/or elastomeric polymers comprising blocks or groups of linked homopolymers. In some implementations, a plasticizer can be added to the elastomeric polymer, for example, to increase plasticity, decrease viscosity and/or friction, and can make elastomeric polymer softer and more flexible. Plasticizers can include hydrocarbon fluids such as mineral oils, and can be aliphatic or aromatic, for instance.

Each layer of the springs can comprise a thermoplastic elastomeric gel (TPEG) which has thermoplastic and elastic qualities. A TPEG can, for example, include elastomeric polymers and/or a plasticizer such that the TPEG is capable of deforming and returning to its original shape and size after deformation. Generally, TPEGs can be melted when heated and formed into a plastic when cooled, such as to form the hybrid spring gels described herein. The TPEG can be a Bio-based and/or fossil-based. For example, the TPEG can be derived from sources such as corn, beets, cellulose, vegetable oil, soya beans, sugar cane, and/or any other suitable plant matter. TPEG can also comprise styrenic block copolymers (e.g., SEPTON®, Kraton polymers, etc.). The TPEG used herein can also include a rubber and/or a hydrogenated rubber, such as ethylene/propylene, ethylene/butylene, or ethylene/ethylene/propylene, etc., which can be plasticized with hydrocarbon fluids.

One or more TPEGs can also be combined with antioxidants, which can, for example, improve the longevity of the product and reduce the effects of thermal degradation in manufacturing (e.g., IRGANOX®, EVERNOX®, etc.). TPEGs can also be formulated to avoid the need for external support, such as a barrier, so the layers have sufficient structural integrity as to not break under normal use.

In some implementations, the layers of the springs of the present disclosure can also be composed of silicone, polyurethane, and/or polyvinyl chloride (PVC).

Figure 6A:
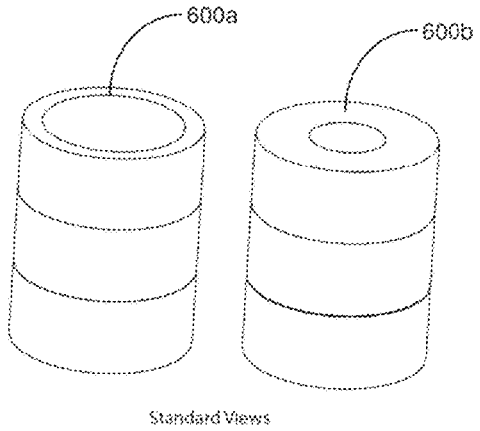
FIGS. 6A and 6B illustrate exemplary spring structures that can be embedded in a support structure matrix.
Figure 6B:
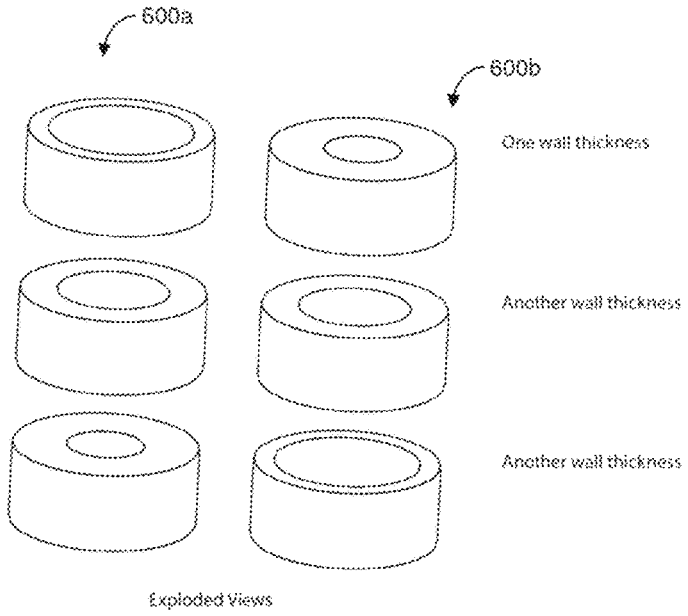

As shown on FIGS. 6 and 7, each layer of the springs can have inner and outer dimensions which differ from one or more other layers. The springs 600*a*-600*b* depicted on FIGS. 6A and 6B, for instance, illustrate that each of the layers of the spring can have the same outer diameter, but different inner diameters. A wall thickness of each layer, i.e., the thickness of material between the inner and outer diameters of the layer, can be varied along the length of the springs 600*a*-600*b* by varying the inner diameter of the layers. For example, as best illustrated by the exploded views of the left and right springs 600*a*-600*b* of FIG. 6B, the wall thickness of each layer can decrease or increase along the length of the spring, from the lower most layer to the upper most layer, respectively. In other examples, the inner diameter and wall thickness of each layer can be varied in any combination and/or arrangement. One layer can, for instance, have a wall thickness greater than each adjacent layer such that the wall thicknesses of the spring does not increase or decrease linearly along its length.

Figure 7A:
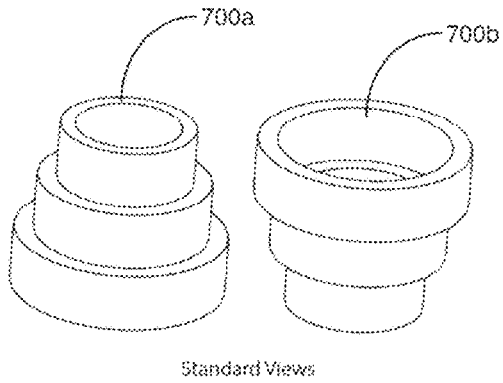
FIGS. 7A and 7B illustrate exemplary spring structures that can be embedded in a support structure matrix.
Figure 7B:
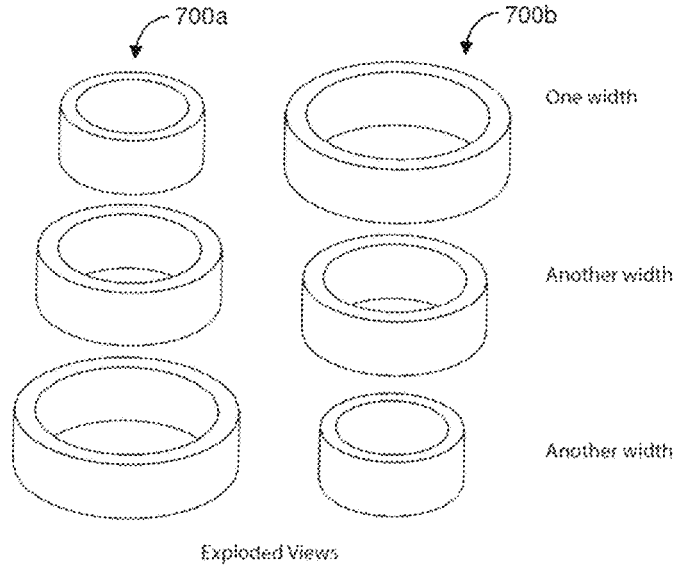

In addition to, or in lieu of having varied inner diameters, the right and left springs 700*a*-700*b* depicted in FIGS. 7A and 7B illustrate that the layers of a spring can have dissimilar outer diameters. As shown in both the assembled and exploded views of the left and right springs 700*a*-700*b*, the outer diameter of each layer can decrease or increase along the length of the spring, from the lower most layer to the upper most layer, respectively. In other examples, the outer diameter of each layer can be varied in any combination and/or arrangement. For example, one layer can have an outer diameter greater than each adjacent layer such that the outer diameter of the spring does not increase or decrease linearly along its length.

Figure 8:
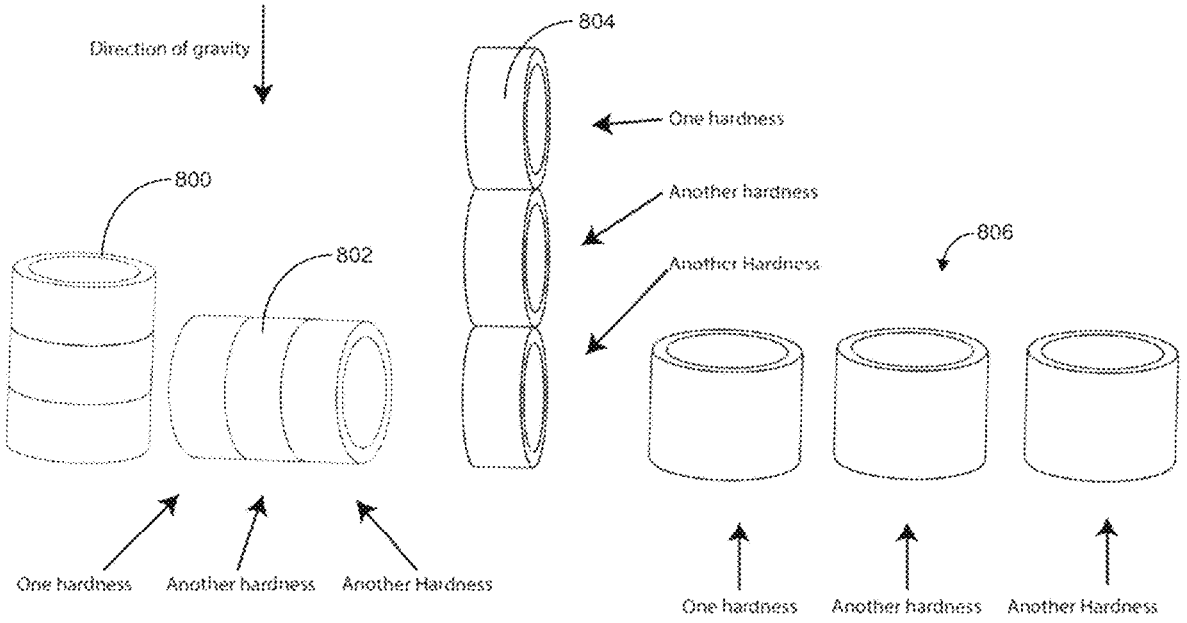
FIG. 8 illustrates exemplary spring structures that can be embedded in a support structure matrix.

As shown on FIG. 8, the springs described herein can have arrangements other than the stacked arrangement of the springs depicted on FIGS. 1-7 (e.g., spring 800). For example, rather than being arranged vertically, the springs can be positioned horizontally within a support structure matrix. In particular, the second spring 802 from the left on FIG. 8 shows that the layers on the outer most ends of the spring can lie within the same horizontal plane. In such examples, the layers can be coaxial with one another and aligned along a common axis of their respective support structure matrix.

In some examples, the layers of springs need not be coaxially aligned. As one example, each layer can be arranged side-by-side with one another in a vertical arrangement. As one example and as illustrated on FIG. 8, each layer of a spring 804 can be connected to an adjacent layer at their circumferential outer surfaces such that the layers are vertically aligned, but not coaxially aligned. As another example, the spring 806 depicted in FIG. 8 shows that, in some instances, the layers need not be in contact with one another, but can be axially spaced from one another along a horizonal plane (or vertical plane).

Figure 9A:
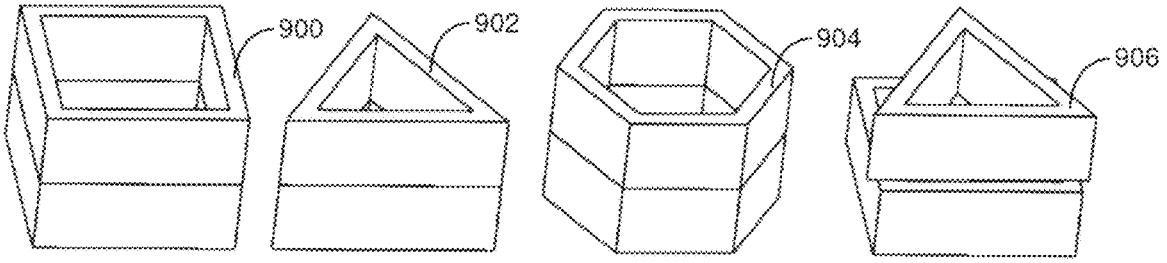
FIGS. 9A and 9B illustrate exemplary spring structures that can be embedded in a support structure matrix.
Figure 9B:
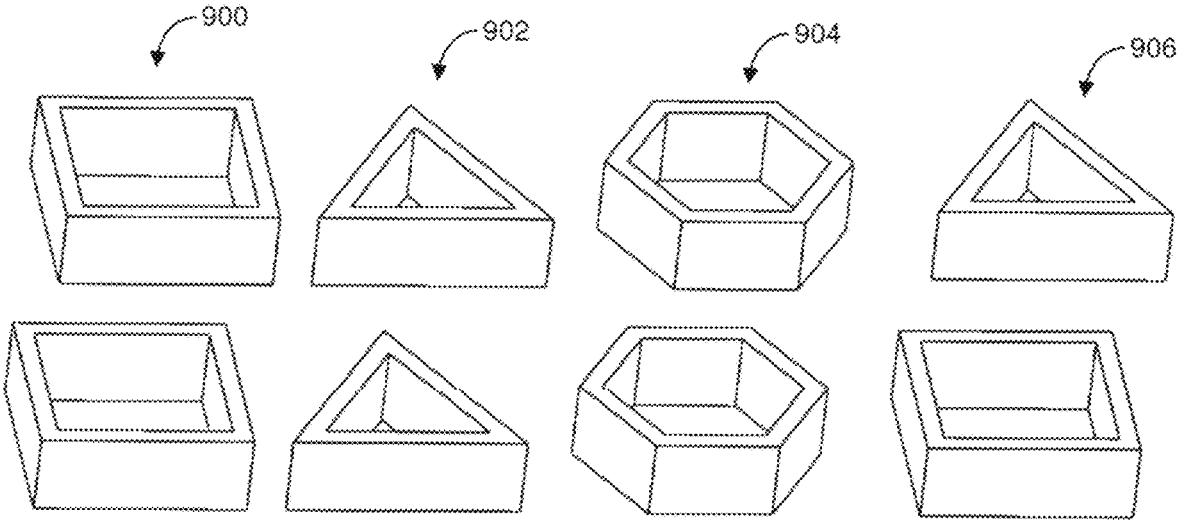

FIGS. 9-11 show that the springs, and the layers thereof can be provided in various geometric shapes, combination of shapes, and/or patterns. As shown in FIGS. 9A and 9B, for example, springs can be formed of two or more square layers (e.g., spring 900), triangular layers (e.g., spring 902), hexagonal layers (e.g., spring 904), and/or any combination thereof (e.g., spring 906). Other geometric shapes can include ovals, parallelograms, pentagons, circles, ovals, helical (e.g., in a spring-like shape), wave patterns, and/or any combination thereof, and those already listed.

Figure 10A:
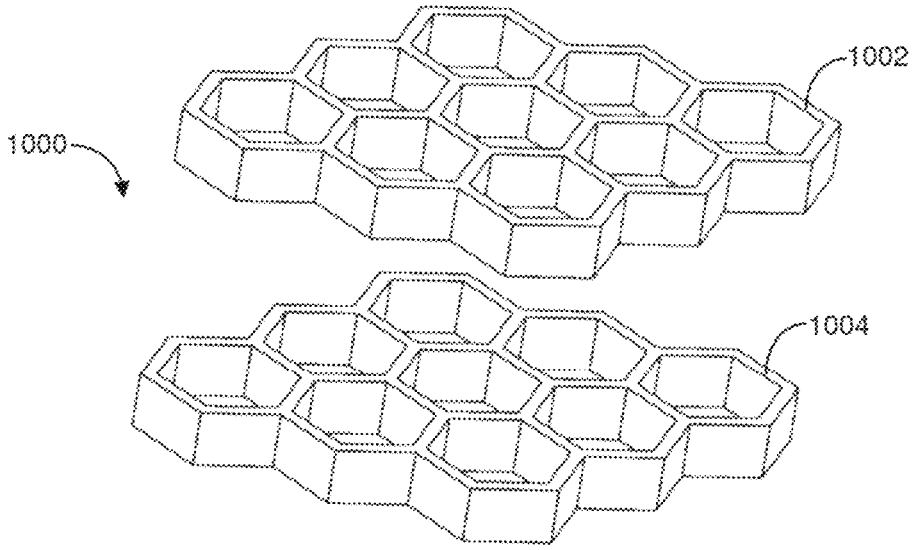
FIGS. 10A and 10B illustrate exemplary spring structures that can be embedded in a support structure matrix.
Figure 10B:
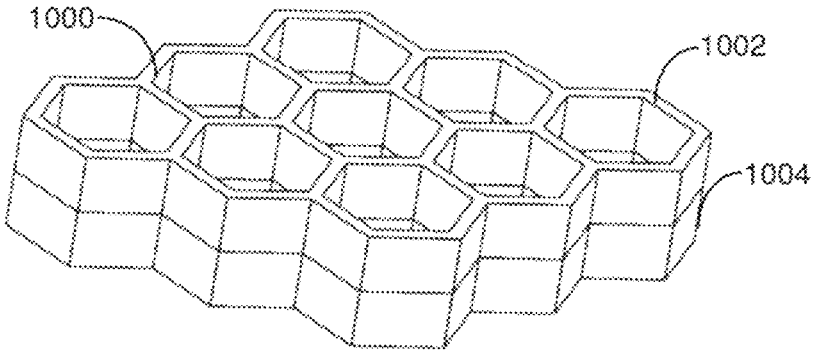

As shown in FIGS. 10A and 10B, two or more layers of the springs described herein can be formed of geometric patterns. As one specific example, a spring 1000 depicted in FIGS. 10A and 10B can have two or more layers 1002, 1004, each layer comprising a pattern of repeating hexagonal cells grouped together and arranged side-by-side. As such, the layers of the spring 1000 of FIG. 10 can be said to have a honeycomb pattern. In other examples, however, one or more layers can be formed of a pattern of other repeating geometric shapes, such as squares, triangles, ovals, parallelograms, pentagons, circles, helical shapes, wave patterns, and/or any combination thereof.

Figure 11A:
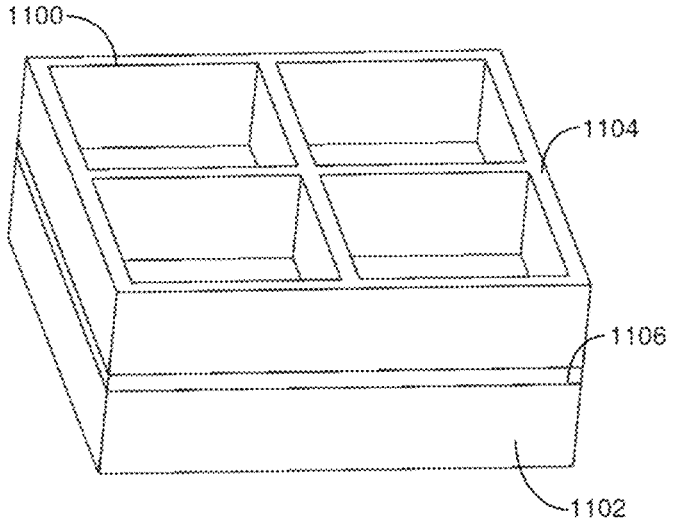
FIGS. 11A and 11B illustrate exemplary spring structures that can be embedded in a support structure matrix.
Figure 11B:
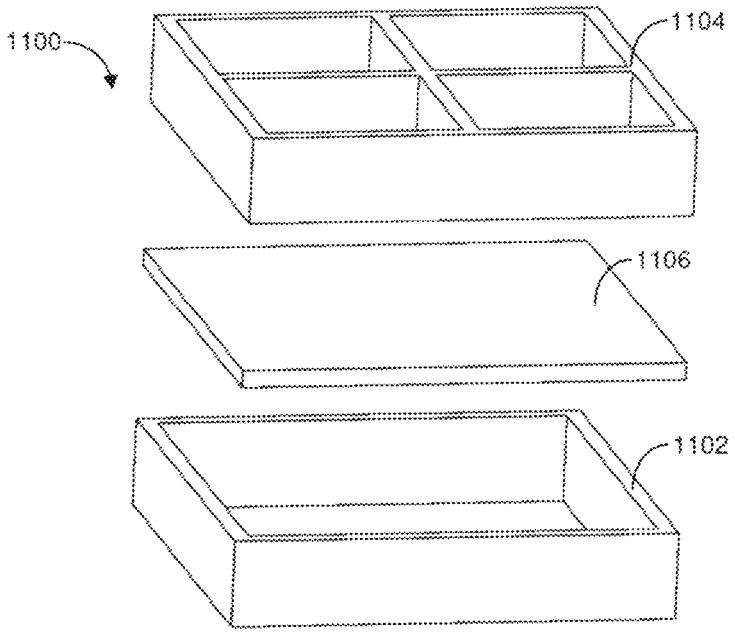

In some examples, such as that illustrated in FIGS. 11A and 11B, one or more layers of a spring 1100 can be formed of a geometric pattern which is a relatively larger or smaller version of the geometric pattern of any of the other layers. For instance, the spring 1100 depicted on FIG. 11 has a first layer 1102 formed of a geometric pattern of repeating squares, which is a relatively larger version of the square geometric pattern that forms the second layer 1104.

As best shown in FIG. 11B, any two layers of the springs described herein can also have a solid dividing layer 1106 between those layers (e.g., first layer 1102 and second layer 1104), as opposed to the two layers being connected and/or in contact with one another. In such configurations, the dividing layer can distribute the downward force applied to the adjacent upper layer, to the adjacent lower layers. In some examples, a spring can include two or more dividing layers between two layers and/or distributed among many layers.

Figure 12:
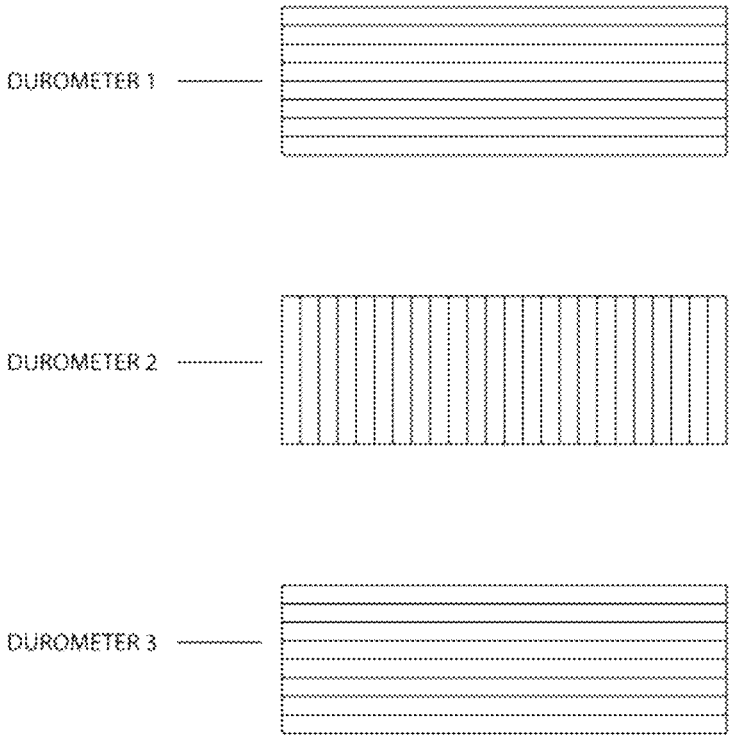
FIG. 12 illustrates exemplary spring layer structures of different durometers.
Figure 13:
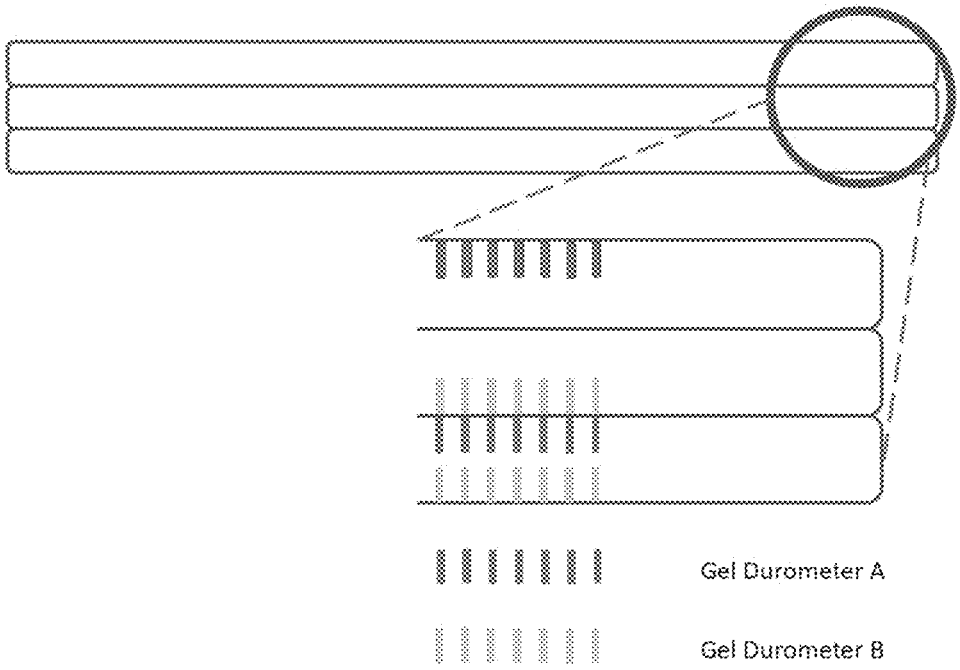
FIG. 13 illustrates exemplary spring layer structures of different durometers.

FIGS. 12 and 13 illustrate additional embodiments of multi-durometer layers, in which each foam layer comprises springs (e.g., gel springs) with different durometers as described herein. For example, as shown in FIG. 12, a first series of layers (horizontal) can be formed with a first durometer (durometer 1), a second series of layers (vertical) can be formed with a second durometer (durometer 2), and a third series of layers can be formed with a third durometer (durometer 3) and these three series of layers can be stacked to form a support structure with a plurality of layers (or series of layers) of different durometers.

FIG. 13 illustrates an example in which adjacent layers have different spring structures (e.g., gel springs) to form multiple durometers resulting in a variable spring force support system with multiple layers (e.g., 2-100+) of gel supported substrate. For example, the spring (e.g., gel spring) in each substrate can be calibrated to an increasing or decreasing durometer (as described above) to provide the desired variable spring force for the system. The spring insertions (e.g., gel springs) can be along the same or multiple axis. Or transposed on either side of one or more of the foam (or other substrate) elements.

As shown in FIG. 13, different spring durometers can be positioned adjacent each other to create different durometer layers. In addition, the position and location of spring members can be varied to further modify function and/or durometer. For example, FIG. 13 shows adjacent layers having springs positioned on a top portion, lower portion, or both, of different layers. In embodiments where the springs are adjacent one another (e.g., in contact with adjacent springs), the springs can be bonded to the adjacent spring structure. For example, a gel spring on a bottom surface of a top layer can be bonded to a gel spring on a top surface of a bottom layer. The spring can also be bonded to the foam of the layer.

Figure 14:
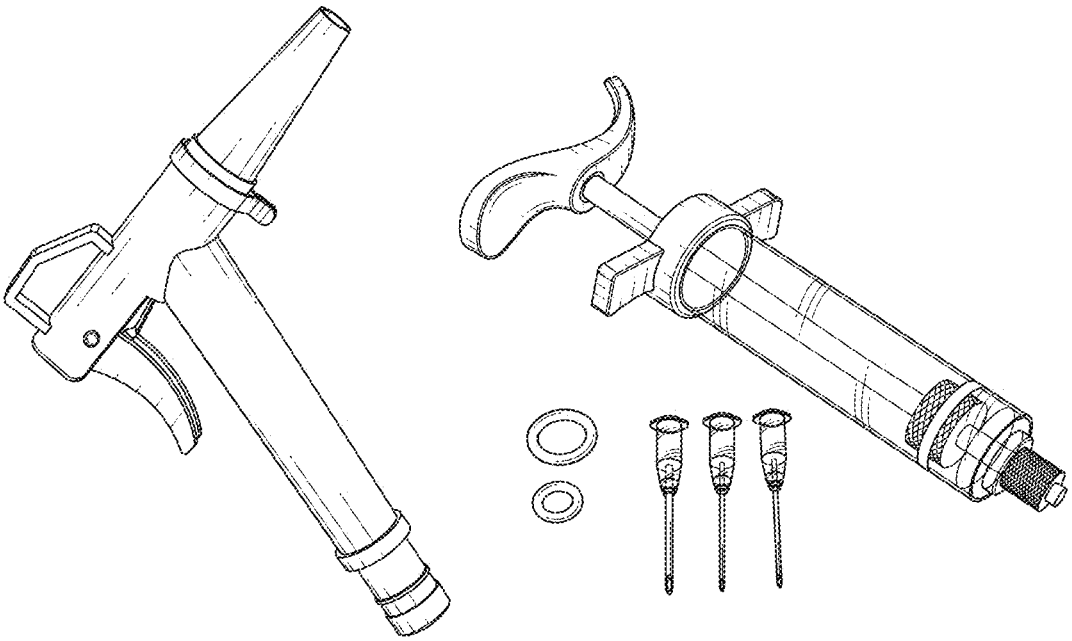
FIG. 14 illustrates exemplary injection devices that can inject materials, such as gels, to form spring structures within a support structure matrix.
Figure 15:
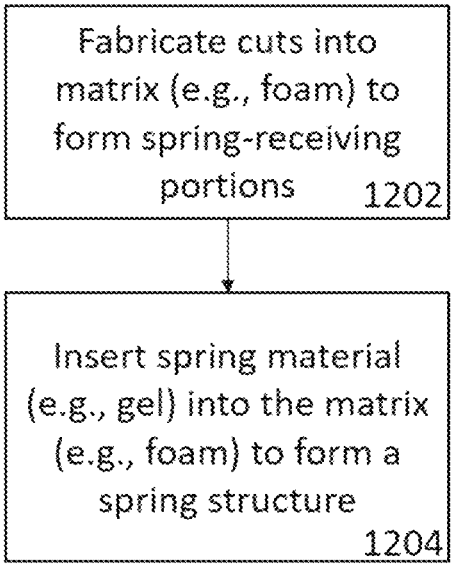
FIG. 15 illustrates a method of forming spring structures in a support structure matrix.

FIG. 14 illustrates exemplary tools that can insert springs (e.g., gel springs) into a matrix (e.g., foam) of a support structure. For example, in one embodiment, as shown in FIG. 15, a method of forming springs in a matrix comprises fabricating cuts into the matrix (e.g., a foam matrix) to form spring-receiving portions (1202). Subsequent to forming the spring-receiving portions, the spring material, such as a gel as described herein, can be inserted into the matrix in the spring-receiving portion to form the spring structure (1204).

The spring members disclosed herein can be deeply embedded, such that it is embedded at least 0.5 inches from a surface of the matrix of the layer, or fully embedded so that the spring member does not extend to a surface of the matrix of the layer.

The specific embodiments disclosed herein are not limiting of the invention, but rather are examples of a broad array of different embodiments that the inventors have envisioned that include the technology disclosed herein. Any of the features or characteristics disclosed herein can be combined in any way with any of the other features or characteristics disclosed herein, as well as with any other known support structure technologies, to form a variety of different embodiments that include or relate to the inventive technology disclosed herein.

We claim:

1. A support structure comprising:

a support structure matrix comprising a plurality of layers; and a plurality of spring structures embedded within the plurality of layers of the support structure matrix, the plurality of spring structures have a plurality of different durometers;

wherein the plurality of spring structures are configured to deform and return to its original shape after deformation, wherein the plurality of layers comprise at least a first layer, a second layer, and a third layer, wherein the spring structures embedded in the first layer have a different durometer than the spring structures embedded in the second layer and third layer, and the spring structures embedded in the second layer have a different durometer than the spring structures embedded in the third layer.

2. The support structure of claim 1, wherein at least some of the spring structures comprise a thermoplastic elastomeric gel.

3. The support structure of claim 2, wherein the thermoplastic elastomeric gel comprises styrenic block copolymers.

4. The support structure of claim 2, wherein the thermoplastic elastomeric gel comprises a rubber and/or a hydrogenated rubber.

5. The support structure of claim 1, wherein at least some of the spring structures are vertically stacked to form a stacked spring system.

6. The support structure of claim 5, wherein the stacked spring system comprises spring structures that have different wall thicknesses.

7. The support structure of claim 5, wherein the stacked spring system comprises spring structures that have different heights.

8. The support structure of claim 5, wherein the stacked spring system comprises spring structures that have different sized radiuses.

9. The support structure of claim 5, wherein the stacked spring system has a lowermost spring structure and an uppermost spring structure, and wherein the spring structures that have durometers that increase from the uppermost spring structure to the lowermost spring structure.

10. The support structure of claim 5, wherein the stacked spring system has a lowermost spring structure and an uppermost spring structure, and wherein the spring structures that have durometers that decrease from the uppermost spring structure to the lowermost spring structure.

11. The support structure of claim 5, wherein the spring structures comprise ring-shaped structures.

12. The support structure of claim 5, wherein the spring structures comprise geometric shapes other than ring-shaped structures.

13. The support structure of claim 5, wherein the spring structures form honeycombed-shaped structures.

14. The support structure of claim 1, wherein the plurality of spring structures in the first layer are spaced apart from one another and aligned with each other in the same horizontal plane of the first layer.

15. The support structure of claim 1, wherein the plurality of spring structures in the first layer are spaced apart from one another and positioned within different horizontal planes, such that some of the plurality of spring structures in the first layer are at a different height than others of the plurality of spring structures in the first layer.

16. The support structure of claim 1, wherein the plurality of spring structures comprise an elastomer, silicone, expanded metal, wood foam, bamboo foam, natural materials, or a combination thereof.

17. The support structure of claim 1, wherein at least some of the spring structures are stacked end-to-end so that they are vertically aligned but not coaxially aligned to form an end-to-end spring system.

18. The support structure of claim 1, wherein at least some of the spring structures comprise different materials and have different durometers.

19. A support structure comprising:

a support structure matrix comprising a plurality of layers; and a plurality of spring structures embedded within the plurality of layers of the support structure matrix, the plurality of spring structures have a plurality of different durometers;

wherein the plurality of spring structures are configured to deform and return to its original shape after deformation, wherein at least some of the spring structures are vertically stacked to form a stacked spring system, and wherein the stacked spring system comprises spring structures that have different wall thicknesses.

20. The support structure of claim 19, wherein at least some of the spring structures comprise a thermoplastic elastomeric gel.

21. The support structure of claim 20, wherein the thermoplastic elastomeric gel comprises styrenic block copolymers.

22. The support structure of claim 20, wherein the thermoplastic elastomeric gel comprises a rubber and/or a hydrogenated rubber.

23. The support structure of claim 5, wherein the stacked spring system comprises spring structures that have different heights.

24. The support structure of claim 5, wherein the stacked spring system comprises spring structures that have different durometers.

25. A support structure comprising:

a support structure matrix comprising a plurality of layers; and a plurality of spring structures embedded within the plurality of layers of the support structure matrix, the plurality of spring structures have a plurality of different durometers;

wherein the plurality of spring structures are configured to deform and return to its original shape after deformation, wherein at least some of the spring structures are vertically stacked to form a stacked spring system, and wherein the stacked spring system comprises spring structures that have different sized radiuses.

26. The support structure of claim 25, wherein at least some of the spring structures comprise a thermoplastic elastomeric gel.

27. The support structure of claim 26, wherein the thermoplastic elastomeric gel comprises styrenic block copolymers.

28. The support structure of claim 26, wherein the thermoplastic elastomeric gel comprises a rubber and/or a hydrogenated rubber.

29. The support structure of claim 25, wherein the stacked spring system comprises spring structures that have different durometers.

30. The support structure of claim 29, wherein the stacked spring system has a lowermost spring structure and an uppermost spring structure, and wherein the spring structures that have durometers that increase from the uppermost spring structure to the lowermost spring structure.

* * * * *